United States Patent [19]

Tanaka et al.

[11] 4,142,889

[45] Mar. 6, 1979

[54] ELECTROPHOTOGRAPHIC PROCESS USING A CADMIUM SULFIDE PHOTOCONDUCTOR HAVING HYSTERESES CHARACTER

[75] Inventors: Susumu Tanaka; Takashi Sugiyama, both of Sakai; Kuniki Seino, Kawasaki; Shoji Kondo, Tokyo, all of Japan

[73] Assignee: Minolta Camera Kabushiki Kaisha, Japan

[21] Appl. No.: 857,196

[22] Filed: Dec. 2, 1977

[30] Foreign Application Priority Data

Dec. 27, 1976 [JP] Japan ..... 51-160373

[51] Int. Cl.[2] ..... G03G 13/22

[52] U.S. Cl. ..... 96/1 R; 96/1.5 R; 96/1.3

[58] Field of Search ..... 96/1.5, 1 R, 1.3

[56] References Cited

U.S. PATENT DOCUMENTS

| | | | |
|---|---|---|---|
| 3,494,789 | 2/1970 | Makino et al. | 96/1.5 |
| 3,724,940 | 4/1973 | Koizumi | 96/1 R |
| 3,883,349 | 5/1975 | Sato | 96/1 R |
| 3,963,488 | 6/1976 | Brushenko | 96/1 R |

*Primary Examiner*—John D. Welsh

*Attorney, Agent, or Firm*—Wenderoth, Lind & Ponack

[57] ABSTRACT

In an electrophotographic process in which a photosensitive member such as $CdS.nCdCO_3$-resin photosensitive member having peculiar hysteresis characteristics is sequentially subjected to pre-charging step, hysteresis charging step, hysteresis exposure step, charging step and image-wise light exposure step, the adjustment of photosensitivity of the photosensitive member by variation of the amount of light in the hysteresis exposure step results in an improvement in image formation.

9 Claims, 14 Drawing Figures

*Fig. 3* *Prior Art*
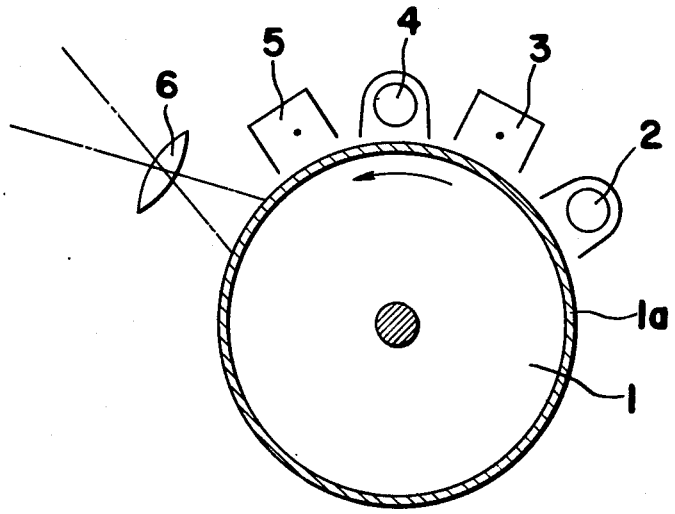
*Fig. 4*
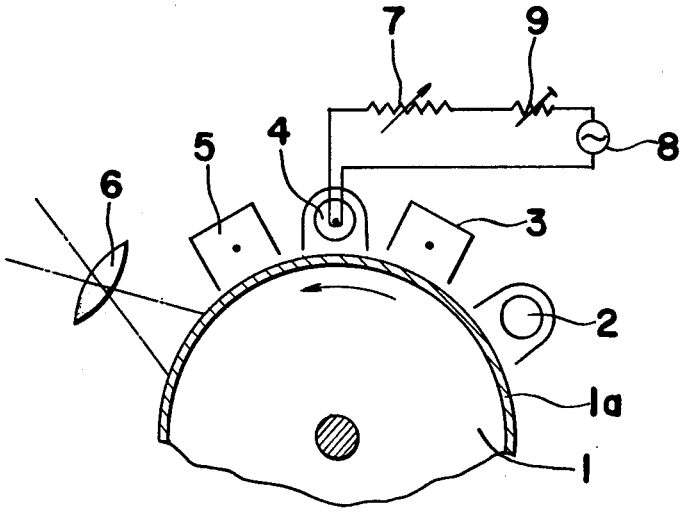

Fig. 7
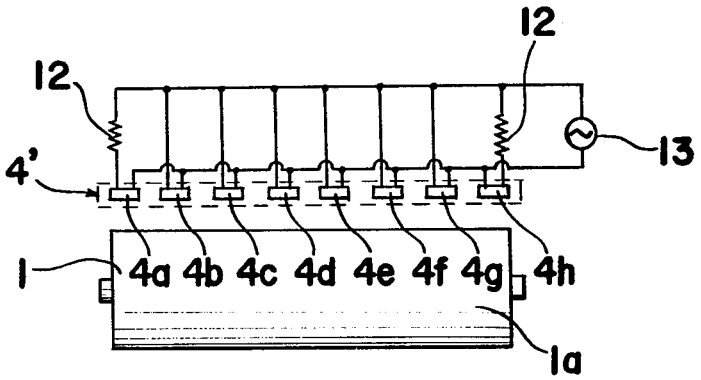
Fig. 8 (A)
Fig. 8 (B)
Fig. 8 (C)
Fig. 8 (D)
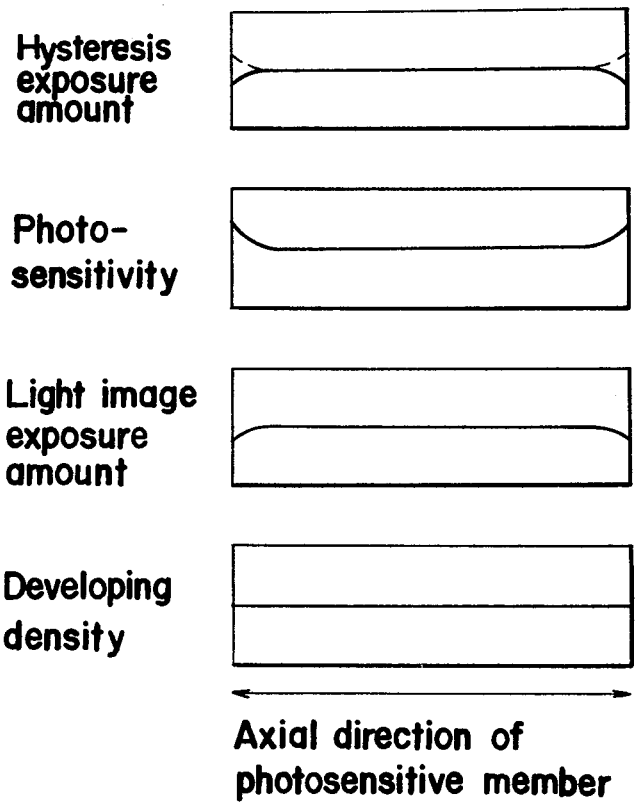

ELECTROPHOTOGRAPHIC PROCESS USING A CADMIUM SULFIDE PHOTOCONDUCTOR HAVING HYSTERESES CHARACTER

BACKGROUND OF THE INVENTION

The present invention relates to an electrophotographic process and more particularly, to a method of adjusting photosensitivity of a photosensitive member or photoreceptor in an electrophotographic process. More specifically, the present invention relates to a method of photosensitivity adjustment of a photosensitive member having peculiar hysteresis characteristics, i.e., a phenomenon in which, when the photosensitive member is subjected to previous processing such as corona charging, exposure to light etc., photosensitivity of the photosensitive member thereafter varies in correspondence with such previous processing as is observed in a photosensitive member which is composed of photoconductive fine particles of cadmium sulfide (CdS) and cadmium carbonate ($nCdCO_3$) ($0<n\leqq 4$) dispersed in a binder resin together with metallic active agent (referred to as a $CdS.nCdCO_3$-resin photosensitive member hereinbelow).

As a result of studies concentrated on the $CdS.nCdCO_3$-resin photosensitive member, the present inventors have found in such a photosensitive member, hysteresis characteristics different from those in other ordinary photosensitive members. More specifically, in the hysteresis characteristics of the ordinary photosensitive member exhibiting fatigue phenomenon, when the photosensitive member is subjected to light projection of high intensity illumination, the electrical charge acceptance capacity of the photosensitive member is reduced to such an extent that the photosensitive member is unable to be used as a photosensitive member unless it is kept in a dark place for a predetermined period of time for restoration of its charge acceptance capacity. On the contrary, the $CdS.nCdCO_3$-resin photosensitive member does not exhibit light projection of fatigue even when exposed to light projection of high intensity illumination and shows good reproducibility repeatedly, with photosensitivity thereof not being affected by such light projection illumination, but upon further charging and exposure of the photosensitive member as previous processing for the subsequent process, the photosensitivity of the photosensitive member thereafter becomes variable, with the degree of variability being altered by the amount of the hysteresis exposure. Such peculiar characteristics of the $CdS.nCdCO_3$-resin photosensitive member are shown in FIG. 1, in which samples a, b, c, d and e of the $CdS.nCdCO_3$-resin photosensitive member ($n\approx 1$) of 40 $\mu$ thick were each sequentially subjected to light projecting processes such as a process equivalent to light projection of more than 1,000 lx.sec., hysteresis charging, hysteresis exposure, charging, and exposure to image-wise light. In the hysteresis charging and the charging, each of the samples a to e was charged up to a surface potential of 1,000 V, while the amount of exposure in the hysteresis exposure was varied to be $10^{-1}$lx.sec. in the sample a, $10^0$ lx. sec. in the sample b, $10^1$ lx.sec. in the sample c, $10^2$ lx. sec. in the sample d, and $10^3$ lx.sec. in the sample e, to observe light attenuation in the light projection corresponding to the exposure to image-wise light. As is seen from corresponding curves a to e in FIG. 1, the photosensitivity at the exposure to image-wise light is varied according to the amount of the hysteresis exposure. Referring also to FIG. 2 showing the above relation more specifically and employing as a measure of the photosensitivity during the exposure to the image-wise light, the reciprocal of the amount of exposure required to reduce the surface potential of the charged photosensitive member to half, it is noticed that the photosensitivity reaches a peak value at a certain amount of exposure P, and that the photosensitivity increases as the amount of exposure increases in a region below the amount of exposure P, while in a region above the amount of exposure P, the photosensitivity decreases as the amount of exposure increases.

As a fundamental image forming method for the photosensitive member having such a peculiar hysteresis characteristics described above, there has conventionally been proposed one method, for example, in U.S. patent application Ser. No. 834,972 by the present inventors, which method is described hereinbelow with reference to FIG. 3. In FIG. 3, around a photosensitive drum 1 in the direction of its rotation indicated by the arrow, there are sequentially disposed a lamp 2, a hysteresis charger 3 for the hysteresis charging, a hysteresis exposure lamp 4 for the hysteresis exposure, a corona charger 5, and an optical system 6 for projecting light image corresponding to the image of an original (not shown) to be copied onto the surface of a photosensitive member 1*a* provided around the photosensitive drum 1. The electrostatic latent image formed thereby may be transferred to the paper directly or through the developing process. It should be noted here that the lamp 2 has functions not only of erasing residual electrical charge on the photosensitive member as in the conventional erasers, but also of removing the effect due to the previous processings of the photosensitive member so that the photosensitive member is not influenced thereafter by such previous processing, and should be clearly distinguished in its functions from the conventional erasers. The lamp 2 has its intensity of illumination set at more than 1,000 lx.sec. for erasing the effects of the previous processing, while the hysteresis charger 3 is adapted to impart charge equal to or more than the surface potential imparted by the charger 5. Meanwhile, the hysteresis exposure lamp 4 is adapted to project light of approximately $10^1$lx.sec. onto the photosensitive member 1*a* so that the photosensitive member 1*a* can be used at its portion having the highest photosensitivity so as to correspond to the curve c of FIG. 1. The image forming method as described above has made it possible to actually use the photosensitive member having the peculiar hysteresis characteristics such as the $CdS.nCdCO_3$-resin photosensitive member which has not been usable in the ordinary image formation due to the influence of the previous processing accompanied by undesirable fogging, memory effect, etc., and is arranged to subject the photosensitive member 1*a* to previous processing so that the photosensitive member has the highest photosensitivity through utilization of the hysteresis characteristics of said photosensitive member.

An essential object of the present invention is to provide an improved electrophotographic process in which photosensitivity adjustments of the photosensitive member are effected for (1) control of reproduction density in a copied image, (2) supplementing brightness or light amount at edge portions of an image field on the photosensitive member, and (3) improvement of gradation reproducibility in the copied image through meshwork resolving function i.e., breaking up of the image into numerous dots.

Another important object of the present invention is to provide an electrophotographic process as described above which is readily applicable to electrophotographic copying apparatuses for incorporation thereinto at low cost.

In accomplishing these and other objects, according to the present invention, the electrophotographic method of copied image formation including the steps of sequentially subjecting photosensitive member whose photosensitivity during exposure thereof to light images varies depending on exposure the amount of light in previous processing, to preexposing step, hysteresis charging process, hysteresis exposure process, charging process and light image exposure process further includes either one or combination of the following three steps:

(1) adjusting the photosensitivity of the photosensitive member by making the amount of light in the hysteresis exposure process uniformly variable in the axial direction of said photosensitive member.

(2) making the photosensitivity at peripheral or edge portions of the photosensitive member larger than that at the central portion of the photosensitive member by selectively increasing or decreasing the amount of light at the peripheral portion of the photosensitive member in the hysteresis exposure process with respect to the amount of light at the central portion of said photosensitive member.

(3) forming a meshwork or dot pattern on the photosensitive member resulting from variation of the light sensitivity through variation in the form of meshwork of the amount of light in the hysteresis exposure process.

By the arrangement as described above, adjustment of contrast in the copied image can be made simultaneously with the reproduction density control, while the insufficiency of amount of light at edge portions on the photosensitive member is eliminated, with a favorable tone gradation reproducibility being achieved through the meshwork resolving function.

BRIEF DESCRIPTION OF THE DRAWINGS

These and other objects and features of the present invention will become apparent from the following description taken in conjunction with the preferred embodiment thereof with reference to the accompanying drawings, in which;

FIG. 4 is a schematic side sectional view, partly broken away, of an arrangement for image forming process according to one embodiment of the present invention, FIG. 7 is a top plan view particularly showing a modification of the hysteresis exposure lamp of FIG. 5 and the photosensitive member associated therewith, FIGS. 8(A) to 8(D) are schematic graphs explanatory of the states of each process according to the arrangement of FIG. 5.

Before the description of the present invention proceeds, it is to be noted that like parts are designated by like reference numerals throughout several views of the accompanying drawings.

DETAILED DESCRIPTION OF THE INVENTION

Figure 1:
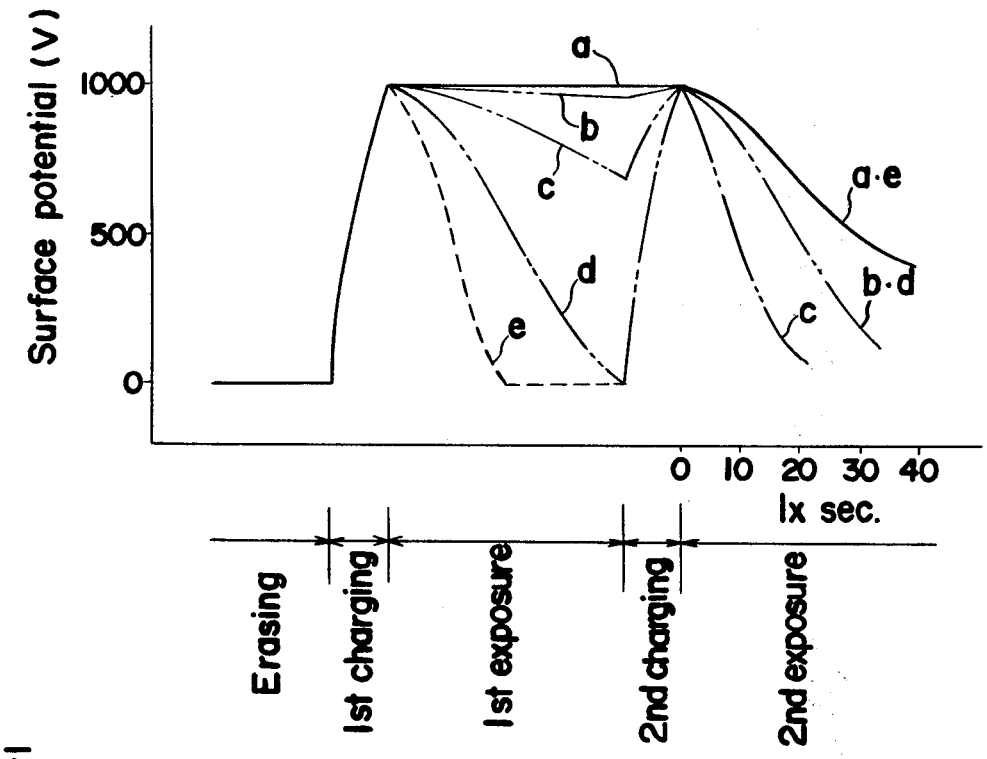
FIGS. 1 and 2 are graphs explanatory of hysteresis characteristics peculiar to a $CdS.nCdCO_3$-resin photosensitive member which have already been referred to, FIG. 3 is a schematic side sectional view explanatory of a fundamental structure of image forming process in a conventional arrangement.

Referring now to the drawings, photosensitivity adjustments of the photosensitive member for (1) control of reproduction density in a copied image, (2) supplementing brightness or light amount at edge portions of an image field on the photosensitive member and (3) improvement of tone gradation reproducibility in the copied image through meshwork resolving function according to the electrophotographic process of the present invention will be described item by item hereinbelow.

(I)

Photosensitivity adjustment for control of reproduction density.

In the conventional reproduction density control, it has been a common practice to adjust, either electrically or mechanically, the amount of exposure at the time of exposure of the photosensitive member to the image-wise light, and since the photosensitivity of the photosensitive member employed is one which may be represented by a single light attenuation curve, the contrast of the copied image is to be determined by what portion of the light attenuation curve is used through adjustment of the amount of exposure, irrespective of preference of an operator.

On the contrary in the present invention, since the photosensitive member employed is one whose photosensitivity is varied during the exposure to image-wise light depending on the amount of exposure in the hysteresis exposure, the most suitable curve can be selected from numerous light attenuation curves present between the maximum sensitivity and minimum sensitivity, if the amount of hysteresis exposure is adapted to be variable, and thus not only the copying density can be controlled, but contrast of the copied image may be readily controlled for presenting clear and definite copied images.

More specifically, referring to FIG. 4 showing similar arrangement to that in FIG. 3 mentioned earlier, the hysteresis exposure lamp 4 is connected to a power source 8 through a voltage regulator 7 with the control knob (not shown) being provided, for example, at a control panel of a copying apparatus frame (not shown) for enabling the operator to adjust the hysteresis exposure amount as he desires. By adjusting the voltage regulator 7 as described above, the photosensitivity of the photosensitive member 1*a* can be varied, for example, as in the three light attenuation curves at the time of exposure to image-wise light shown in FIG. 1, and thus the density of the image to be reproduced become different even with respect to the same amount of imagewise light exposure for simultaneous control of the contrast in the copied image.

In the arrangement of FIG. 4 according to the present invention, it is also possible to further provide an auxiliary voltage regulator 9 in series with the voltage regulator 7 with a control knob (not shown) of the auxiliary voltage regulator 9 being provided in the copying apparatus (not shown), to enable a servicing personnel to manipulate the knob during adjustment of individual copying apparatuses for setting the previous maximum amount of exposure and minimum amount of exposure, i.e., the maximum sensitivity and minimum sensitivity that can be imparted to the photosensitive member to achieve the optimum condition. Additionally, if the amount of light of the hysteresis exposure lamp 4 for the reproduction density adjustment is set to the region above the amount of exposure P in FIG. 2, accurate control can be effected due to its gradual variation, but the same amount of light may be set to the region below the amount of exposure P depending on necessity.

According to an experiment carried out by the present inventors through employment of the apparatus of FIG. 4 on the reproduction density adjustment as described in the foregoing, the amount of hysteresis exposure was adjusted as to satisfactorily reproduce an "area" image and "fine line" image on surfaces of high quality Kent paper having reflection density of 0.01, ordinary white paper having reflection density of 0.2 and colored paper having reflection density of 0.3. In the arrangement of FIG. 4, the $CdS.nCdCO_3$-resin photosensitive member 1*a* ($n \approx 1$) of 40 $\mu$ film thickness was employed, and the lamp 2 was set at the amount of exposure of 1,000 lx.sec., while the chargers 3 and 5 are respectively set at 750 V in the surface potential to be charged, with the hysteresis exposure lamp 4 being made to be variable in the exposure amount from 5 lx.sec. to 200 lx.sec.

Table 1

| Reflection density at non-image portion of original | image-wise light exposure light amount from non-image portion | Surface potential when hysteresis exposure light amount is constant | Set value for hysteresis exposure amount | Surface potential at non-image portion of original |
|---|---|---|---|---|
| 0.01 | 15 (lx.sec.) | 80 (V) | 110 (lx.sec.) | 153 (V) |
| 0.2 | 9.8 | 140 | 20 | 149 |
| 0.3 | 7.7 | 195. | 9 | 151 |

From the above Table 1, it is noticed that the amount of light exposure from the non-image portion of the original reaching the photosensitive member varies appreciably due to difference in the reflection density of the original, although the light amount from the illuminating light source is the same. Table 1 also shows attenuation of the surface potential of the photosensitive member by the image-wise light exposure, on the assumption that the amount of hysteresis exposure is made constant. Commonly, in the development of an electrostatic latent image, a predetermined bias voltage in the order of approximately 160 V is impressed for standardization so that no fogging is developed on ordinary white paper. In this case, however, since the non-image portion having the reflection density of 0.3 has a potential of 195 V as is seen from the above Table 1, fogging is developed at the non-image portion of the copied image. When the amount of hysteresis exposure was set as in Table 1 to prevent the occurrence of the fogging depending on the original, the surface potential at the non-image portion of each original was reduced to approximately 150 V. As a result of subsequent development carried out during impression of a bias voltage of 160 V based on the known xerox system, no fogging was formed in the non-image portions of the whole original, with image portions thereof also being reproduced satisfactorily.

Meanwhile, in the control of reproduction density by the conventional adjustment of the amount of exposure, one could not help but note the fogging formed at the non-image portions for reproducing an image of low reflection density on paper having comparatively high reflection density, but according to the method of the present invention, it has been possible to satisfactorily reproduce the original having small difference in reflection densities between the non-image portions and image portions, because the reproducing density can be adjusted, with the contrast between the image portions and non-image portions maintained at a high state.

(II)

Photosensitivity adjustment for supplementing brightness at edge portions of an image field In a copying apparatus, when a lens assembly is employed for an optical system, it is impossible to avoid the influence by the known $Cos^4$ law or Cosine law. Since the brightness at peripheral or edge portions becomes insufficient according to the $Cos^4$ law, it has been a general practice to supplement the the amount of light at the edge portions by providing between the optical system and the photosensitive member a slit whose width is gradually increased toward the edge portions in an axial direction of the photosensitive member to increase the amount of light reaching such edge portions. Following the recent improvement in copying apparatuses of compact size, however, photosensitive drums of small diameter and short focal length lenses are extensively employed for the copying apparatuses. The short focal length lens, having a shallow depth of focus has a disadvantage that when it is combined with a photosensitive drum of small diameter, the photosensitive member tends to be exposed to the imagewise light beyond the depth of focus at the edge portions having large slit width, thus giving rise to indefiniteness of the image at such edge portions.

According to the present invention, the disadvantages due to insufficient brightness or light amount of the edge portions inherent in the conventional arrangements have advantageously been eliminated by increasing the photosensitivity at such edge portions of the photosensitive member through alteration of the amount of exposure in the axial direction of the photosensitive member during the hysteresis exposure, so that the insufficiency in brightness at the edge portions is supplemented by high photosensitivity, even when the exposure to image-wise light is effected through a slit of a predetermined constant width.

Figure 5:
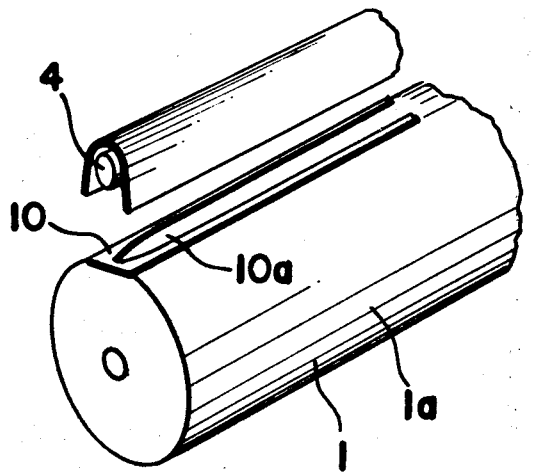
FIG. 5 is a perspective view, on an enlarged scale and partly broken away, particularly showing the state of a slit member disposed between a hysteresis exposure lamp and the photosensitive member according to another embodiment of the present invention.
Figure 6:
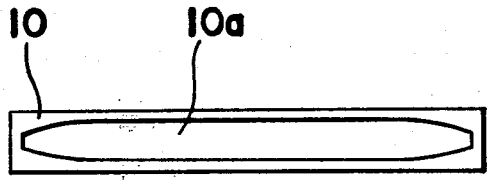
FIGS. 6(A) and 6(B) are top plan views of slit members employable in the arrangement of FIG. 5.
Figure 6:
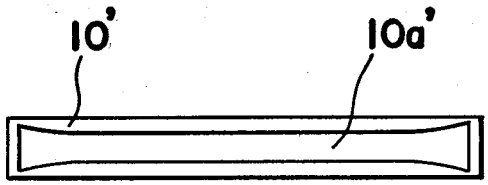

Referring particularly to FIG. 5, showing one preferred embodiment of the present invention, between the hysteresis exposure lamp 4 and the photosensitive surface 1*a* of the photosensitive drum 1 in the arrangement described with reference to FIG. 3, there is further disposed a slit member 10 having a slit 10*a* formed therein, with the width of the slit 10*a* being altered at the edge or peripheral portions in the axial direction of the photosensitive drum 1. When the amount of exposure of the hysteresis exposure lamp 4 is above the amount of exposure P of FIG. 2, the slit member 10 having the slit 10*a* whose width is gradually narrowed toward its opposite edge portions as shown in FIG. 6(A) is employed, while on the other hand, if the amount of exposure of the hysteresis exposure lamp 4 is below the amount of exposure P of FIG. 2, a slit member 10′ having a slit 10*a*′ whose width is gradually broadened toward its opposite edge portions as shown in FIG. 6(B) can be employed.

Referring also to FIG. 7, there is shown a modification of the arrangement of FIG. 5. In this modification, light amount of the hysteresis exposure lamp itself is varied in the axial direction of the photosensitive drum 1, and for this purpose, the hysteresis exposure lamp 4 described as employed in the arrangement of FIG. 5 is replaced by a hysteresis exposure lamp 4′ which includes a number of small lamps, for example, lamps 4*a*, 4*b*, 4*c*, 4*d*, 4*e*, 4*f*, 4*g* and 4*h* arranged in the axial direction of the photosensitive drum 1, with only the lamps 4*a* and 4*h* at opposite end portions of the row of the small lamps 4*a* to 4*h* being coupled to a power source 13 through resistors 12, while other lamps 4*b* to 4*g* are directly connected to the power source 13 for varying the amount of light in the axial direction of the photosensitive drum 1. When the light amount of the hysteresis exposure lamp 4′ is below the exposure amount P of FIG. 2, the above arrangement may be modified to connect only the small lamps 4*b* to 4*g* to the power source 13 through suitable corresponding resistors (not shown), with the lamps 4*a* and 4*h* being directly connected to the power source 13.

Figure 2:
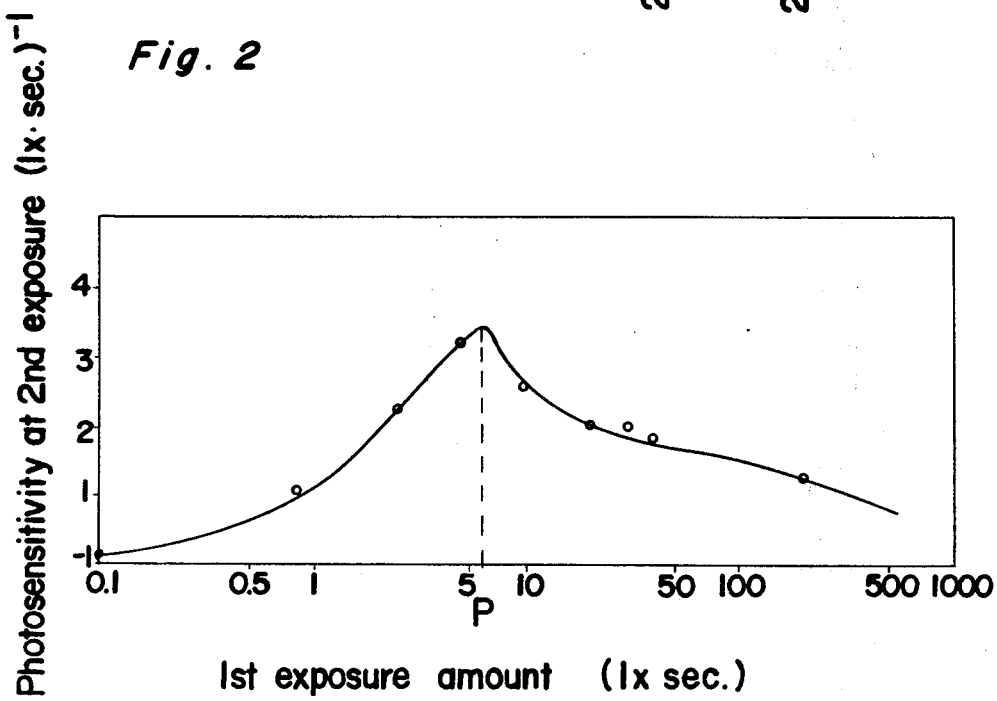

Referring also to FIG. 8(A) showing the amount of light of the hysteresis exposure lamp varied in the axial direction of the photosensitive member in a solid line when the amount of light of the exposure lamp is above the amount of exposure P and in a dotted line when the light amount of the exposure lamp is below the exposure amount P of FIG. 2, if the amount of light of the hysteresis exposure lamp 4 is varied in the axial direction of the photosensitive member, the photosensitivity of the photosensitive member is increased at the opposite edge portions in the axial direction of the photosensitive drum as shown in FIG. 8(B), and even when the photosensitive member is subjected to exposure to image-wise light (FIG. 8(C)) having insufficient brightness at the edge portions due to the $Cos^4$ law, such insufficiency of amount of light is supplemented by high photosensitivity at the edge portions, with the resultant reproduction density being made uniform (FIG. 8(D)) in the axial direction of the photosensitive drum. Such countermeasures for the insufficient brightness at the edge portions during the hysteresis exposure are advantageous for ordinary copying apparatuses in general, but are particularly effective for copying apparatus employing the short focal length lens and photosensitive drum of small diameter as described above.

Based on the knowledge that, with a short focal length lens having a focal length of 150 mm employed for a copying apparatus, when an original 210 mm in width (A4 size) is illuminated by a uniform illuminating light source for the original, the light amount is reduced by approximately 55% at the edge portions based on the $Cos^4$ law, the present inventors carried out an experiment as described hereinbelow. In the experiment, the optical system was constituted by the short focal length lens having focal length of 150 mm as described above, an original illuminating light source having a uniform amount of light in the axial direction of the photosensitive member, and a slit member having a light image exposure slit of uniform width, while the hysteresis exposure lamp was divided into eight small lamps as in FIG. 7 to be aligned at a predetermined interval with respect to the length of 220 mm in the axial direction of the photosensitive member with other arrangements for the eraser, charger, etc., being the same as in the experiment mentioned earlier. By the above arrangement, an original of white paper was subjected to copying under conditions where the small lamps 4*a* and 4*h* at the opposite edge portions were set at 7.6 lx.sec. and other small lamps 4*b* to 4*f* at 20 lx.sec., (when the amount of hysteresis exposure amount is set above the amount of exposure P (FIG. 2)), and another condition where the small lamps 4*a* and 4*h* at the opposite edge portions were set at 4.8 lx.sec. and other small lamps 4*b* to 4*g* at 2.2 lx.sec. (when the amount of hysteresis exposure is set below the amount of exposure amount P (FIG. 2)), with the result that no fogging is formed at the opposite edge portions of the copied images. On the contrary, in the a similar experiment carried out for comparison, with all of the small lamps 4*a* to 4*h* set at 3 lx.sec. formation of fogging was noticed at the opposite edge portions. As is clear from the above experiments, the insufficiency of light amount at the opposite edge portions due to the $Cos^4$ law is advantageously compensated for by increasing the photosensitivity of the photosensitive member at the edge portions thereof through variation of the amount of hysteresis exposure amount between the central portion and edge portions of the photosensitive member.

(III) Photosensitivity adjustment for improvement of tone gradation reproducibility in the copied image through meshwork resolving function It is known that the meshwork resolving effect is employed for faithful reproduction of an original having continuous tone gradation. For obtaining the meshwork resolving effect, the image to be projected onto the photosensitive member is subjected to meshwork resolving by a grid-shaped screen or a screen having dot pattern and disposed in a position immediately before the light of the image-wise light exposure reaches the photosensitive member for improving the tone gradation reproducibility. The above known arrangement, however, has a disadvantage that if the screen as described above is placed in a path of the light of the image-wise light exposure, the amount of light reaching the photosensitive member is decreased, thus requiring the light amount from the illuminating light source to be increased. Meanwhile, the increase of in the amount of light of the illuminating light source further heats the portions to be illuminated, and thus more powerful cooling means therefor is inevitably required. Furthermore, it is extremely difficult to provide the dot pattern screen in the image-wise light exposure portion wherein the slit width is hard to make very narrow, since such dot pattern screen must be disposed quite close to the photosensitive member. Such a restriction as described above is quite remarkable when the photosensitive member of drum configuration is employed.

Figure 9:
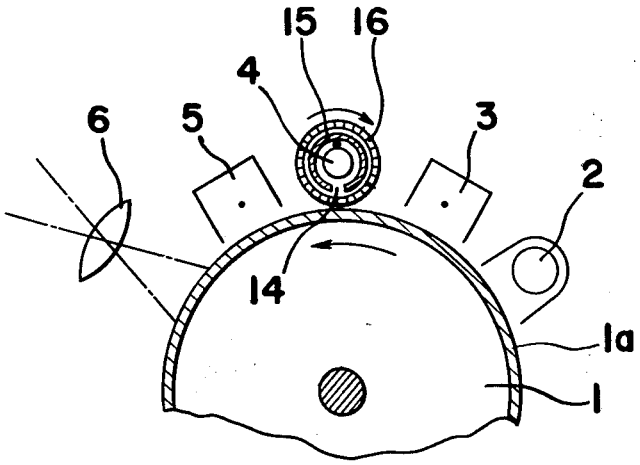
FIG. 9 is a similar view to FIG. 5, but particularly shows a further embodiment of the arrangement for the image forming process according to the present invention.

Referring to FIG. 9 showing another embodiment of the present invention, it is so arranged that the tone gradation reproducibility is improved by providing a meshwork or dot pattern screen in the hysteresis exposure lamp to form dots corresponding to magnitude of the photosensitivity on the photosensitive member itself for effecting light image exposure. In FIG. 9 in which the lamp 2, hysteresis charger 3, hysteresis exposure lamp 4, charger 5, optical system 6 are disposed around the photosensitive surface 1*a* of the photosensitive drum 1 in the similar manner as in FIG. 3, the hysteresis exposure lamp 4 is housed in a cylindrical member 15 having a narrow slit 14 on its periphery facing the photosensitive surface 1*a* of the photosensitive drum 1, while the cylindrical member 15 is further enclosed in a cylindrical dot pattern screen 16 as shown. It is to be noted that the dot pattern screen 16 is disposed very close to the photosensitive surface 1*a* of the drum 1 and is rotated in a direction opposite to that of the photosensitive drum 1 as shown by the arrow at a circumferential speed equal to that of the drum 1. It is also to be noted that, although the dot pattern of the screen 16 may be selected as desired, a dot pattern having density gradient is most preferable.

Figure 10:
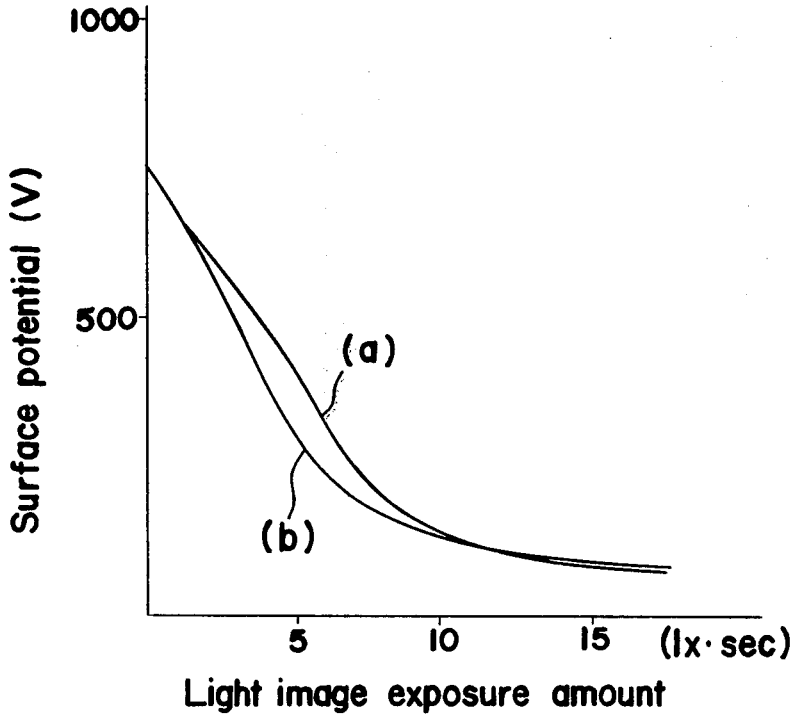
FIG. 10 is a graph explanatory of dot effect according to the arrangement of FIG. 9.

For better understanding, on the assumption that a dot pattern screen having light transmittance in two steps is employed, portions having photosensitivity which corresponds to the two steps are to be alternately arranged on the photosensitive surface 1*a*, and the light attenuation curve thereby is divided into a curve (a) having gentle light attenuation and a curve (b) having sharp light attenuation as shown in FIG. 10. When the photosensitive member having two kinds of photosensitivity in the form of meshwork as described above is subjected to the exposure to image-wise light, the meshwork resolving effect is small at the shadow portion, i.e., portion of the photosensitive member subjected to projection of reflected light from a portion having high density of the original image, since the light amount is small, with the difference in the photosensitivity between the curves (a) and (b) not being conspicuous. Meanwhile, at a highlighted portion, i.e., portion subjected to light reflected from the non-image portion of the original, the meshwork resolving effect is also small, since due to the large amount of light, the photosensitivity for the curves (a) and (b) is reduced to approximately the same. It should be noted here, however, that at a portion of intermediate gradation, i.e., at a region at which the amount of light reaching the photosensitive member is between the shadow and highlight portions, a good gradation reproducibility is obtained since the photosensitivity divided into two kinds is subjected to meshwork resolution.

Still referring to a graph of FIG. 10 obtained by measuring the light attenuation during the image-wise light exposure at the hysteresis exposure amounts of 10 lx.sec. (curve (a)) and 7 lx.sec. (curve (b)) respectively, the present inventors carried out another experiment for actual copying with the arrangement of FIG. 9, with the transmittance of the two steps mentioned earlier being set at 92% and 64% so that the hysteresis exposure amounts in the meshwork become 10 lx.sec. and 7 lx.sec., while the hysteresis exposure lamp 4 is set at 11 lx.sec., with other data being set to be the same as in the experiment described earlier. As a result of the above experiment, it was found that the reproduction of the intermediate tone was satisfactory.

It should be noted here that in the foregoing embodiments, although the three photosensitivity adjusting methods are described separately, such methods may of course be combined in various ways for application, depending on necessity.

As is clear from the foregoing description, according to the present invention, in the image formation in which the photosensitive member having the peculiar hysteresis characteristics such as the $CdS.nCdCO_3$-resin photosensitive member is sequentially subjected to the pre-exposing process, hysteresis charging process, hysteresis exposure process, charging process and image-wise light exposure process, the process of the image formation is improved through variation of the amount of light in the hysteresis exposure.

In conclusion, the present invention may be summarized as follows.

Firstly, the light amount in the hysteresis exposure as described above is made adjustable so as to be increased or decreased for control of reproduction density through adjustment of the photosensitivity of the photosensitive member, which method is useful in that adjustment of contrast can be made simultaneously with the control of reproduction density control.

Secondly, the insufficiency of brightness at the edge portions of the photosensitive member inherent in the optical system is eliminated by increasing the photosensitivity of the photosensitive member at the edge portions thereof through variation of the amount of hysteresis exposure light only at the edge portions in the axial direction of the photosensitive member. The above arrangement of the present invention in which the insufficiency of the light amount at the edge portions is eliminated in the hysteresis exposure process is particularly effective for reducing the size of a copying apparatus, for example, by combining a short focal length lens with a photosensitive drum of small diameter.

Thirdly, by varying the amount of light in the hysteresis exposure in the form of meshwork for the formation of dots corresponding to the magnitude of the photosensitivity on the photosensitive member, a favorable gradation reproducibility is achieved through the meshwork resolution effect.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An electrophotographic process for forming an electrostatic latent image corresponding to an original onto a photosensitive member comprising $CdS.nCdCO_3$ ($0<n\leqq 4$) and having hysteresis characteristics in which the photosensitivity of said photosensitive member in an image exposing step varies in accordance with the previous exposure and/or charging level, comprising the steps of:

(a) pre-exposing said photosensitive member at an exposure level greater than $10^3$ lx.sec.;

(b) uniformly charging said photosensitive member with a specific polarity to a predetermined surface potential;

(c) exposing said photosensitive member with light of varying exposure level;

(d) uniformly charging said photosensitive member to a predetermined surface potential with the same polarity as in charging step (b); and (e) exposing the image corresponding to the original onto the uniformly charged photosensitive member, said photosensitive member exhibiting variable photosensitivity in step (e) by variation of the amount of exposure of the photosensitive member during exposure step (c).

2. An electrophotographic process for forming an electrostatic latent image corresponding to an original onto a photosensitive member comprising $CdS.nCdCO_3$ ($0<n\leqq 4$) having hysteresis characteristics in which the photosensitivity of said photosensitive member in an image exposing step varies in accordance with the previous exposure and/or charging level, comprising the steps of:

(a) pre-exposing said photosensitive member at an exposure level greater than $10^3$ lx.sec;

(b) uniformly charging said photosensitive member with a specific polarity to a predetermined surface potential for hysteresis charging;

(c) exposing said photosensitive member with a light source of varying exposure level for hysteresis exposure;

(d) uniformly charging said photosensitive member to a predetermined surface potential with the same polarity as in the hysteresis charging step (b); and (e) exposing the image corresponding to the original onto the uniformly charged photosensitive member for image exposure, said photosensitive member exhibiting variable photosensitivity in step (e) by variation of the amount of exposure of the photosensitive member during exposure step (c), whereby the latent image exhibits improved contrast and density in a positive image formed therefrom.

3. An electrophotographic process as claimed in claim 2, wherein the variation of the amount of exposure of the photosensitive member in step (c) is effected by adjusting the power supplied to said light source.

4. An electrophotographic process for forming an electrostatic latent image corresponding to an original onto a movable photosensitive member comprising $CdS.nCdCO_3$ ($0<n\leqq 4$) having hysteresis characteristics in which the photosensitivity of said photosensitive member in an image exposing step varies in accordance with the previous exposing and/or charging level, comprising the steps of:

(a) pre-exposing said photosensitive member with an exposure level greater than $10^3$ lx.sec. for pre-exposure;

(b) uniformly charging said photosensitive member with a specific polarity to a predetermined surface potential for hysteresis charging;

(c) exposing said photosensitive member with a light source of exposure level varying in a direction intersecting the movement of the photosensitive member in correspondence with reduction of brightness at edge portion of a lens system employed in the image exposing step for hysteresis exposure;

said image exposure being effected in slit-like form onto said photosensitive member;

(d) uniformly charging said photosensitive member to a predetermined surface potential with the same polarity as in the hysteresis charging step (b); and (e) exposing the image corresponding to the original onto the uniformly charged photosensitive member for image exposure, said photosensitive member exhibiting variable sensitivity in a direction intersecting the direction of movement of the photosensitive member by varying the amount of exposure in step (c) of the photosensitive member in said direction intersecting the direction of movement of the photosensitive member, said hysteresis exposure thereby increasing photosensitivity at opposite edge portion in the axial direction of said photosensitive member so as to offset the reduction of brightness at edge portion of the lens system in the image exposure for achieving formation of the image uniform in the axial direction.

5. An electrophotographic process as claimed in claim 4, wherein the variation in the amount of exposure of the photosensitive member in the hysteresis exposure step (c) is effected by inserting a slit member having different slit widths in the longitudinal direction between said light source and said photosensitive member.

6. An electrophotographic process as claimed in claim 4, wherein the variation in amount of exposure to the photosensitive member in the hysteresis exposure step (c) is effected by dividing the said light source into a plurality of light sources in a direction intersecting direction of movement of said photosensitive member and by making light intensity of each of said plurality of light sources different.

7. An electrophotographic process for forming an electrostatic latent image corresponding to an original onto a movable photosensitive member comprising $CdS.nCdCO_3$ ($0<n\leqq 4$) having hysteresis characteristics in which the photosensitivity of said photosensitive member in an image exposing step varies in accordance with the previous exposure and/or charging level, comprising the steps of:

(a) pre-exposing said photosensitive member with an exposure level greater than $10^3$ lx.sec. for pre-exposing;

(b) uniformly charging said photosensitive member with a specific polarity to a predetermined surface potential for hysteresis charging;

(c) exposing said photosensitive member with a light source having its exposure level modulated through meshwork resolution for hysteresis exposure;

(d) uniformly charging said photosensitive member to a predetermined surface potential with the same polarity as in the hysteresis charging step (b); and (e) exposing the image corresponding to the original onto the uniformly charged photosensitive member for image exposure, said photosensitive member exhibiting variable sensitivity by varying the amount of exposure of the photosensitive member through the mesh-like form in the exposure step (c), thereby providing improved intermediate tone reproducibility.

8. An electrophotographic process as claimed in claim 7, wherein in said hysteresis exposure step (c), said moving photosensitive member is subjected to light projection in slit-like form and the variation in the amount of exposure in said hysteresis exposure step is effected by inserting a screen member having different degrees of light transmittance in a mesh-like form between said light source and said photosensitive member, while moving said screen member in the same direction as the direction of movement of the photosensitive member.

9. An electrophotographic process as claimed in claim 7 wherein the variation of the amount of exposure in the hysteresis exposure step (c) is effected by inserting a screen member having different degrees of light transmittance in the mesh-like form between the light source and the photosensitive member.

* * * * *